US006771282B2

(12) United States Patent
Yanagi et al.

(10) Patent No.: US 6,771,282 B2
(45) Date of Patent: Aug. 3, 2004

(54) MATRIX DISPLAY DEVICE PROVIDING A LARGER CONNECTION PITCH

(75) Inventors: Toshihiro Yanagi, Nara (JP); Takafumi Kawaguchi, Taki-gun (JP); Taketoshi Nakano, Ise (JP)

(73) Assignee: Sharp Kabushiki Kaisha, Osaka (JP)

( * ) Notice: Subject to any disclaimer, the term of this patent is extended or adjusted under 35 U.S.C. 154(b) by 230 days.

(21) Appl. No.: 09/851,838

(22) Filed: May 9, 2001

(65) Prior Publication Data

US 2002/0000968 A1 Jan. 3, 2002

(30) Foreign Application Priority Data

May 10, 2000 (JP) ..... 2000-137709
Feb. 21, 2001 (JP) ..... 2001-045655

(51) Int. Cl.[7] ..... G09G 5/02

(52) U.S. Cl. ..... 345/695; 345/87; 345/695; 345/274

(58) Field of Search ..... 348/274; 345/695

(56) References Cited

U.S. PATENT DOCUMENTS 4,288,812 A * 9/1981 Rhodes ..... 348/274
4,855,724 A * 8/1989 Yang ..... 345/88
6,326,981 B1 * 12/2001 Mori et al. ..... 345/695

FOREIGN PATENT DOCUMENTS

JP 60-131522 A 7/1985
JP 07-072826 3/1995
JP 07-122712 12/1995
JP 08-095027 4/1996

* cited by examiner

*Primary Examiner*—Steven Saras
*Assistant Examiner*—Ming-Hun Liu
(74) *Attorney, Agent, or Firm*—David C. Conlin; George W. Hartnell, III; Edwards & Angell, LLP

(57) ABSTRACT

In a matrix display device, when cells of first to third colors composing one pixel are first to third cells, the second cell is disposed on one side of the first cell in a signal line alignment direction while disposing the third cell on the other side of the first cell in a scanning line alignment direction, and the first to third cells form the shape of a letter L. One pixel and another pixel adjacent to either side of the former pixel in the scanning line alignment direction are a first pixel in the shape of the letter L and a second pixel in the shape of the letter L and in a state rotating by 180° with respect to the first pixel, respectively. The first and second pixels are paired with each other and a combination of these pixels form the shape of a square, where all the first pixels and all the second pixels respectively have the same combination of colors of the first to third cells, and the first and second pixels have a difference in disposition of colors, thus realizing high-definition display with a low-cost arrangement.

20 Claims, 12 Drawing Sheets

MATRIX DISPLAY DEVICE PROVIDING A LARGER CONNECTION PITCH

FIELD OF THE INVENTION

The present invention relates to a matrix display device, representative of which is an active matrix liquid crystal display device, and in particular to a matrix display device capable of color display.

BACKGROUND OF THE INVENTION

In a conventional active matrix display device for example, an externally inputted video signal which has an arrangement of M×3 (RGB)×N is displayed, as shown in FIG. 10, by a matrix display section (display element) 58 which is made up of M×3 signal lines, N scanning lines, and display cells each of which is a portion enclosed by the signal lines and the scanning lines. Note that, in "M×3 (RGB)×N", "3 (RGB)" refers to a numerical value 3 according to three different colors: red (R), green (G) and blue (B).

Further, in this active matrix display device, as shown in FIG. 9, each one pixel 51 is made up of three cells 52 (52*a* to 52*c*), one of which is red (R), another is green (G) and the other is blue (B). In each cell 52, a ratio of the length in a horizontal direction ("horizontal length", hereinafter) to the length in a vertical direction ("vertical length", hereinafter) is as follows: the horizontal length:the vertical length=1:3. Namely, as shown in FIG. 9, when the horizontal length of the cell 52 is Sx2, and the vertical length thereof is Sy2, Sx2:Sy2=1:3.

Further, since each pixel 51 includes three cells 52 disposed side by side in the horizontal direction, the pixel 51 has the shape of a square. More specifically, as shown in FIG. 9, when the horizontal length of the pixel 51 is Px2, and the vertical length thereof is Py2, Px2 (=3×Sx2):Py2 (=Sy2)=1:1. With this arrangement, when displaying a "circle" for example, display shows the "circle" but not an "ellipse".

Furthermore, a wiring pitch of the M×3 signal lines 53 and the N scanning lines 54 that are disposed in a matrix shows the following ratio: a pitch of the signal line 53:a pitch of the scanning line 54=1:3.

The foregoing conventional matrix display device that includes the pixel 51, the signal line 53 and the scanning line 54 has an arrangement as shown in FIG. 10, for example. FIG. 10 shows the case where the pixels 51 are provided, the number of which is calculated as follows: M (the number of pixels in a horizontal direction)×N (the number of pixels in a vertical direction). An arrangement shown in FIG. 10 is as follows: each signal line 53 is connected to a signal line driving circuit 55; each scanning line 54 is connected to a scanning line driving circuit 56; the signal line driving circuit 55 is supplied with a video signal and a control signal from a control circuit 57; and the scanning signal line driving circuit 56 is supplied with a control signal from the control circuit 57.

Here, for ease of explanation, FIG. 11 shows a low-resolution matrix display device in which the number of the pixels 51 is calculated as follows: M (horizontal direction)=3, and N (vertical direction)=2. This display device has a basic arrangement as with FIG. 10. Further, FIG. 12 is a timing chart of various signals in the signal line driving circuit 55 shown in FIG. 11.

As shown in FIG. 12, the signal line driving circuit 55, in a timing ① of DOT_CK, makes sampling of each cell 52 of the pixel 51, for example, in an upper left-hand corner in FIG. 11, that is, video data of three individual systems respectively corresponding to R (0,0), G (0,0) and B (0,0). The sampling data are applicable to signals of three systems Sr(0), Sg(0) and Sb(0) to be outputted to the signal line 53. Likewise, at timings ② and ③, there is made sampling of video data of three individual systems respectively corresponding to R (1,0), G (1,0) and B (1,0), and R (2,0), G (2,0) and B (2,0). These sampling data correspond to signals of three systems Sr(1), Sg(1) and Sb(1), and Sr(2), Sg(2) and Sb(2), respectively, that are outputted to the signal line 53.

Thus, the signal line driving circuit 55 finishes sampling of one scanning portion of video data (video data of the three individual systems) which corresponds to a scanning line G(0) (scanning line 54), thereafter outputting the signals Sr, Sg and Sb of the three individual systems corresponding to these sampling data to each signal line 53. Likewise, the signal line driving circuit 55 makes sampling of one scanning portion of video data (video data of the three independent systems) which correspond to a next scanning line G(1) at timings ④, ⑤ and ⑥, so as to output the signals Sr, Sg and Sb of the three independent systems corresponding to these sampling data to each signal line 53.

Since the video signal is a digital signal, in the case of an arrangement of FIG. 11, when, for example, a video signal of RGB 8 bits is adopted, 3 systems (Sr, Sg and Sb)×8 bits, thereby requiring 24 sampling circuits.

However, in the foregoing conventional arrangement, a signal line has a pitch which is three times smaller than that of the scanning line 54 and is an extremely small pitch. Therefore, when attempting to realize a high-definition panel, from the view points of a panel design rule and/or a driver connection rule, a high-definition panel cannot be developed.

For example, when designing a high-definition panel having display density of about 200 dpi based on the foregoing conventional arrangement, one pixel 51 becomes 120 μm□ (120 μm×120 μm), and therefore, each cell 52 and each signal line 53 has the pitch of 40 μm. Further, commonly, the pitch of connection between each output terminal of the signal line driving circuit 55 and each signal line 53 is measured the same as the wiring pitch of the signal line 53. However, according to the currently existing technology, the acceptable finest pitch in the connection is 50 μm, and therefore, the pitch of about 40 μm as above cannot be adopted.

Note that, Japanese Unexamined Patent Publication No. 95027/1996 (Tokukaihei 8-95027 published on Apr. 12, 1996) discloses an arrangement in which a ratio of a cell pitch in a horizontal direction to a cell pitch in a vertical direction is set at a predetermined value. Japanese Unexamined Patent Publication No. 72826/1995 (Tokukaihei 7-72826 published on Mar. 17, 1995) discloses an arrangement in which cells composing one pixel are disposed in the shape of a letter L. However, neither of these techniques aims to loosen the tight pitch of a signal so as to attain high-definition display, and moreover, simply using these techniques cannot solve the foregoing problems.

For example, the following process is disclosed in the Publication No. 72826/1995. When performing display of a video signal having the resolution (800×3(RGB)×600) by a display device having the different resolution of XGA (1024×3(RGB)×768) for example, the pseudo-interpolation and enlargement of the resolution causes the edges of an image to be unclear. Therefore, in this conventional invention, though one pixel is normally made up of three cells R, G and B, yet the number of cells to compose a pixel is variable in accordance with the inputted resolution, thereby preventing the edges of an image from being unclear in a plurality of resolutions. More specifically, in the same Publication, when inputting a signal having the resolution of FIG. 2(A), one pixel is given one of each of the cells R, G and B. Further, when inputting a signal having the resolution of FIG. 2(B), one pixel is given two of each of the cells R, G and B, namely, six cells in total.

SUMMARY OF THE INVENTION

In view of the foregoing problems, it is an object of the present invention to provide a matrix display device capable of high-definition display that was not reached by conventional technology, by a low-cost arrangement in which a small pitch of a signal line is made larger so as to allow a connection pitch of the signal line to be larger.

In order to attain the foregoing object, a matrix display device according to the present invention which has a plurality of signal lines and a plurality of scanning lines crossing one another, and a plurality of pixels each one of which includes three cells of first, second and third colors, wherein:

when the cells of first to third colors composing one pixel are first to third cells in an arbitrary sequence, the second cell is disposed on one side of the first cell in a direction orthogonal to the signal lines ("signal line alignment direction", hereinafter) while disposing the third cell on the other side of the first cell in a direction orthogonal to the scanning lines ("scanning line alignment direction", hereinafter), and the first to third cells form the shape of a letter L, one pixel and another pixel adjacent to either one side of the former pixel in the scanning line alignment direction are a first pixel in the shape of the letter L and a second pixel in the shape of the letter L and in a state rotating by 180° with respect to the first pixel, respectively, the first and second pixels being paired with each other and disposed so that the combination of the two pixels form a square, and all the first pixels have the same combination of colors of the first to third cells, and all the second pixels have the same combination of colors of the first to third cells.

With the foregoing arrangement, the number of cells in the signal line alignment direction and the number of signal lines can be reduced. This realizes a wider connection pitch between the signal line driving circuit and the signal line while allowing a wiring pitch of the signal line and the connection pitch between the signal line driving circuit and the signal line to be smaller, thereby producing a high-definition matrix display device.

Note that, thus having the smaller wiring pitch of the scanning line and connection pitch between the scanning line and the scanning line driving circuit raises no problems because these pitches are originally set to be larger than pitches on the side of the signal lines.

Additional objects, features, and strengths of the present invention will be made clear by the description below. Further, the advantages of the present invention will be evident from the following explanation in reference to the drawings.

BRIEF DESCRIPTION OF THE DRAWINGS

FIG. 6(*b*) is an explanatory view showing an opening portion of a cell of a conventional matrix display device.

DESCRIPTION OF THE EMBODIMENTS

The following will explain one embodiment of the present invention with reference to FIGS. 1 through 8.

Figure 2:
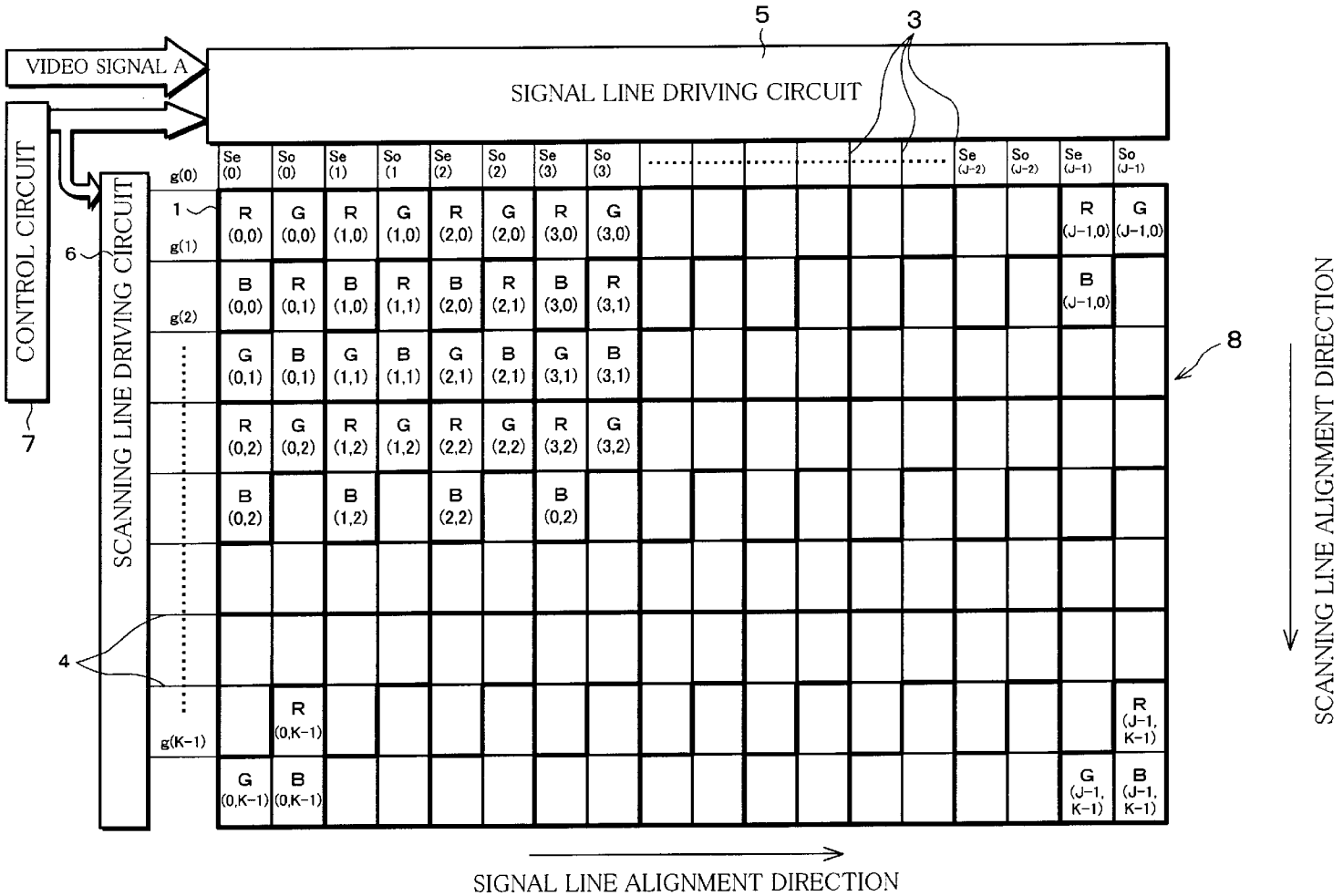
FIG. 2 is a schematic view showing an overall configuration of the matrix display device having the arrangement of a pixel shown in FIG. 1.

Matrix display devices according to one embodiment of the present invention include, for example, an active matrix display device which has an arrangement in which, as shown in FIG. 2, display of a video signal A inputted from the outside is performed by an active matrix display section (display element) 8 which includes J×2 signal lines, K scanning lines, and display cells each of which is a portion enclosed by the signal lines and the scanning lines.

It is arranged that the video signal A be displayed by a display element having J×2 cells 2 in a direction orthogonal to the signal lines 3 ("signal line alignment direction", hereinafter, shown in FIG. 2) and K cells 2 in a direction orthogonal to the scanning lines 4 ("scanning line alignment direction", hereinafter, shown in FIG. 2).

Figure 1:
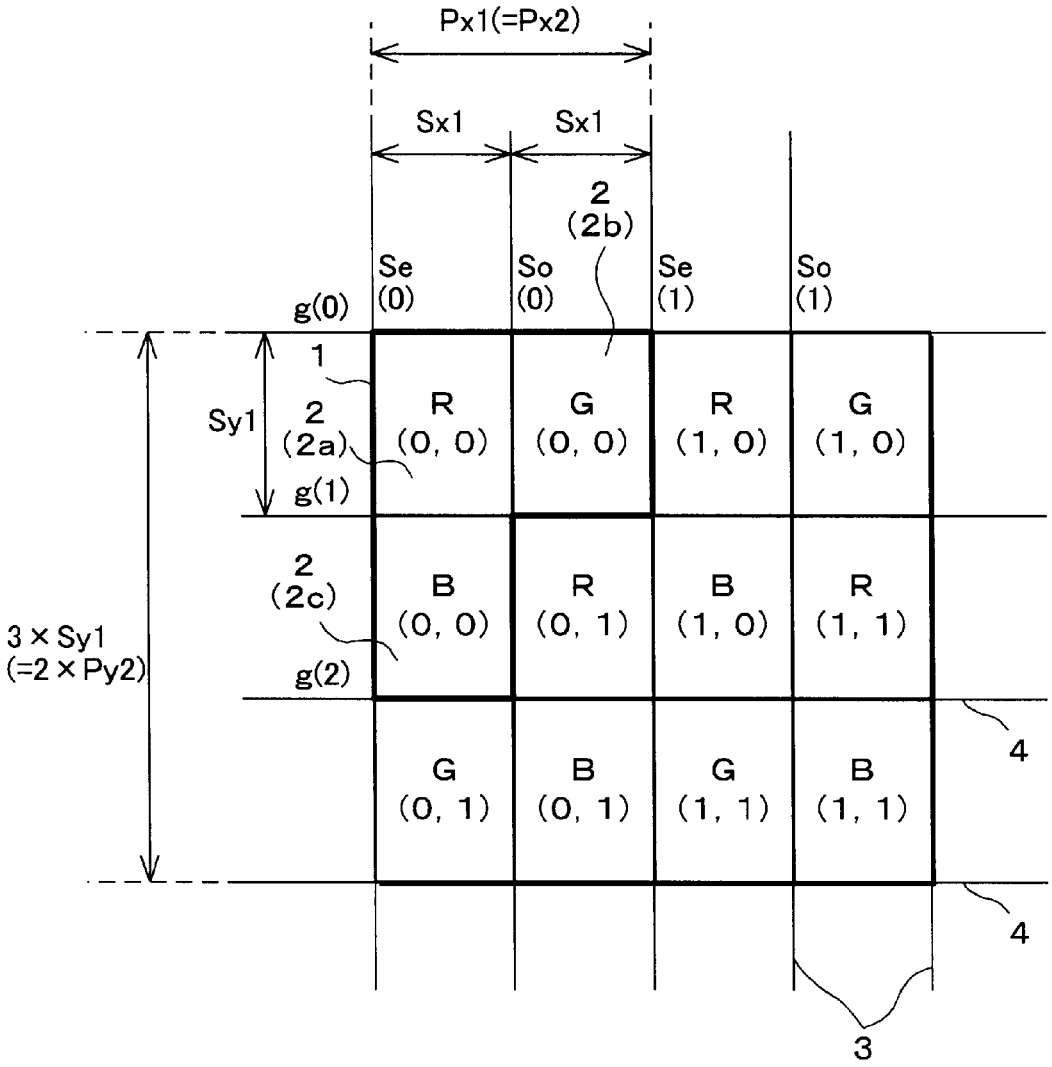
FIG. 1 is an explanatory view showing an arrangement of a pixel made up of a plurality of cells and a disposing state of signal lines and scanning lines of a matrix display device according to one embodiment of the present invention.

In this active matrix display device, as shown in FIG. 1, one pixel 1 is made up of three cells 2 (2*a* to 2*c*) of red (R), green (G) and blue (B), where one side of each cell 2 extends in a horizontal direction (the signal line alignment direction) and the other side extends in a vertical direction (the scanning lines alignment direction), and a ratio of the lengths of the two sides is as follows: horizontal length:vertical length=1.5:2. Namely, as shown in FIG. 1, when one cell 2 has the horizontal length of Sx1, and the vertical length of Sy1, Sx1:Sy1 1.5:2.

Further, in one pixel 1, the three cells 2 composing this one pixel 1 is disposed in the shape of a letter L. More specifically, the three cells 2 (2*a* to 2*c*) of red, blue and green are disposed in such a manner that, when an arbitrarily selected cell 2 (a red cell 2*a*, for example) is set to be the center, on either of the left or right hand side of the red cell 2*a* is disposed another arbitrarily selected cell 2 (green cell 2*b*, for example), and the other cell 2 (blue cell 2*c*, for example) is disposed on either an upper or lower side of the center cell 2 (red cell 2*a*).

Furthermore, when one pixel 1 is a first pixel, and when another pixel 1 disposed adjacent to either one side of the first pixel in the scanning line alignment direction is a second pixel, the first and second pixels are paired with each other and disposed so that a combination of the two pixels both in the shape of the letter L form a square (rectangular shape).

In that case, the second pixel is in a state rotating by 180° with respect to the first pixel. Further, two of the cells 2 (for example, a blue cell 2*c* and a red cell 2*a*) which are respectively selected from the cells 2 respectively composing the two pixels 1 in combination are scanned on a single scanning line 4.

The combinations of the first and second pixels, each of which is disposed in the same manner in scanning line alignment direction, are aligned in the signal line alignment direction. When setting the three cells 2 composing one pixel 1 as first to third cells, all the first pixels have the first to third cells of a single color disposition, and likewise, all the second pixels have the first to third cells of a single color disposition.

Further, with regard to the square formed by the combination of the first and second pixels, a ratio of the length of a side in the signal line alignment direction to the length of a side in the scanning line alignment direction is 1:2.

Further, as described, when setting the three cells 2 composing one pixel 1 as first to third cells, all the pixels 1 aligning side by side in the signal line alignment direction have the same combination of colors in the first and second cells.

Further, a ratio of the number of pixels 1 aligned in the signal line alignment direction to the number of signal lines 3 is 1:2, and a ratio of the number of pixels 1 aligned in the scanning line alignment direction to the number of scanning lines 4 is 2:3.

Further, cells 2 which are adjacently disposed in the signal line alignment direction and in the scanning line alignment direction, respectively, have a difference in color.

As shown in FIG. 2, in the active matrix display device, the number of pixels 1 disposed is calculated as follows: J (the number of pixels in a horizontal direction)×K (the number of pixels in a vertical direction). In FIG. 2, each signal line 3 is connected to a signal line driving circuit 5, while each scanning line 4 is connected to a scanning line driving circuit 6. The signal line driving circuit 5 is supplied with a video signal A and a control signal from a control circuit 7, while the scanning line driving circuit 6 is supplied with a control signal from the control circuit 7.

Figure 3:
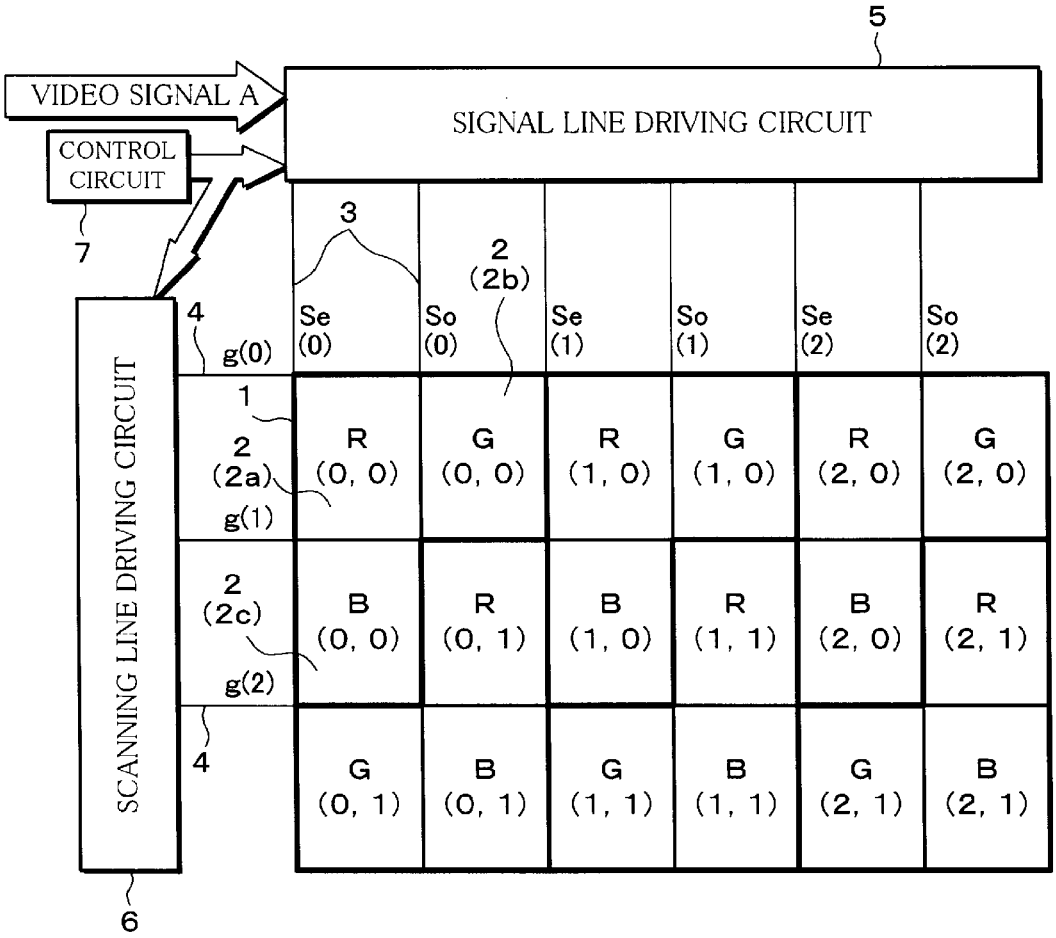
FIG. 3 is a schematic view of the matrix display device of FIG. 2 in the case where J=3 and K=3 (signal lines: 3×2 lines, scanning lines: 3 lines).
Figure 4:
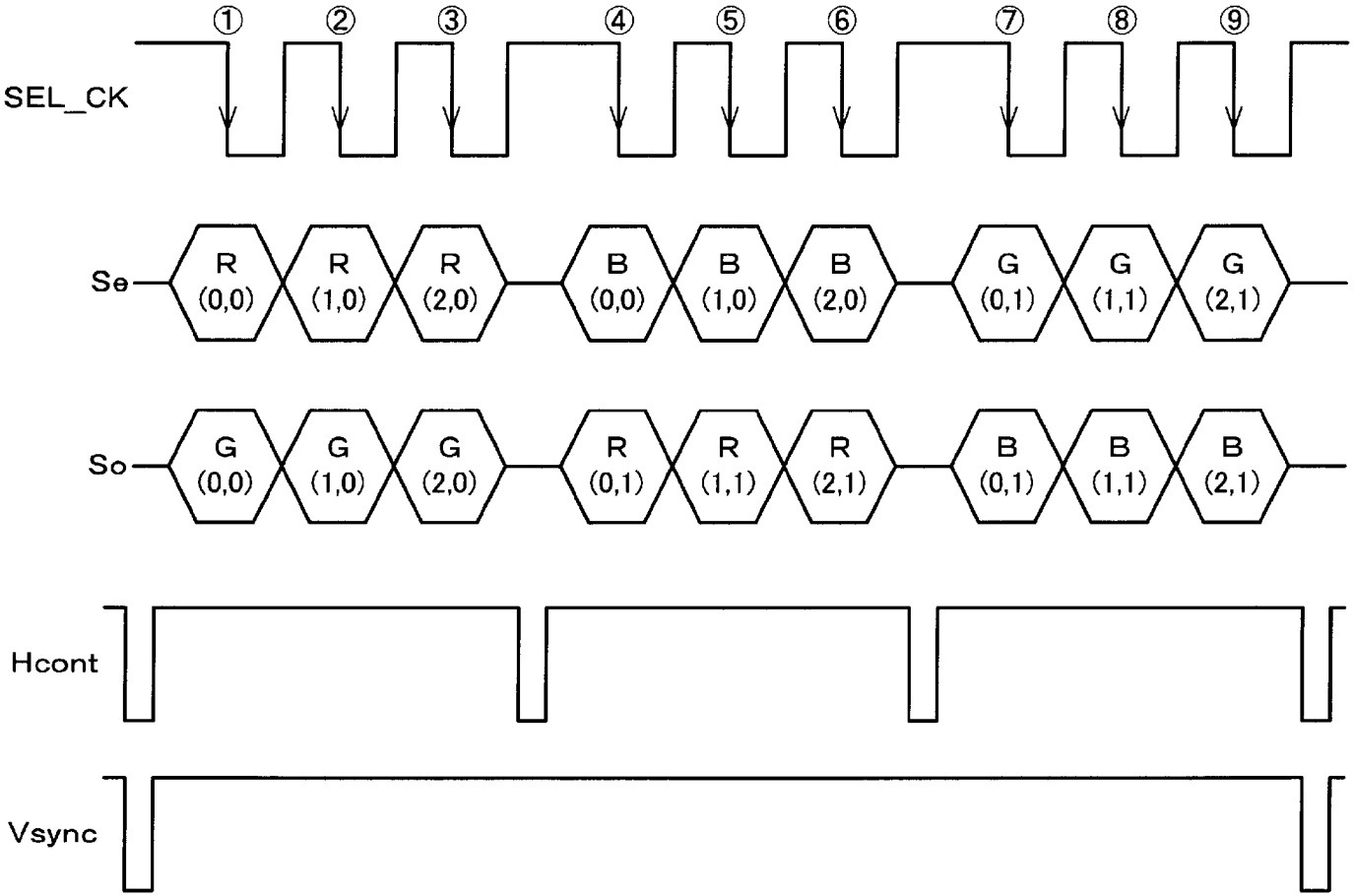
FIG. 4 is a timing chart of various signals in a signal line driving circuit of the matrix display device shown in FIG. 3.
Figure 10:
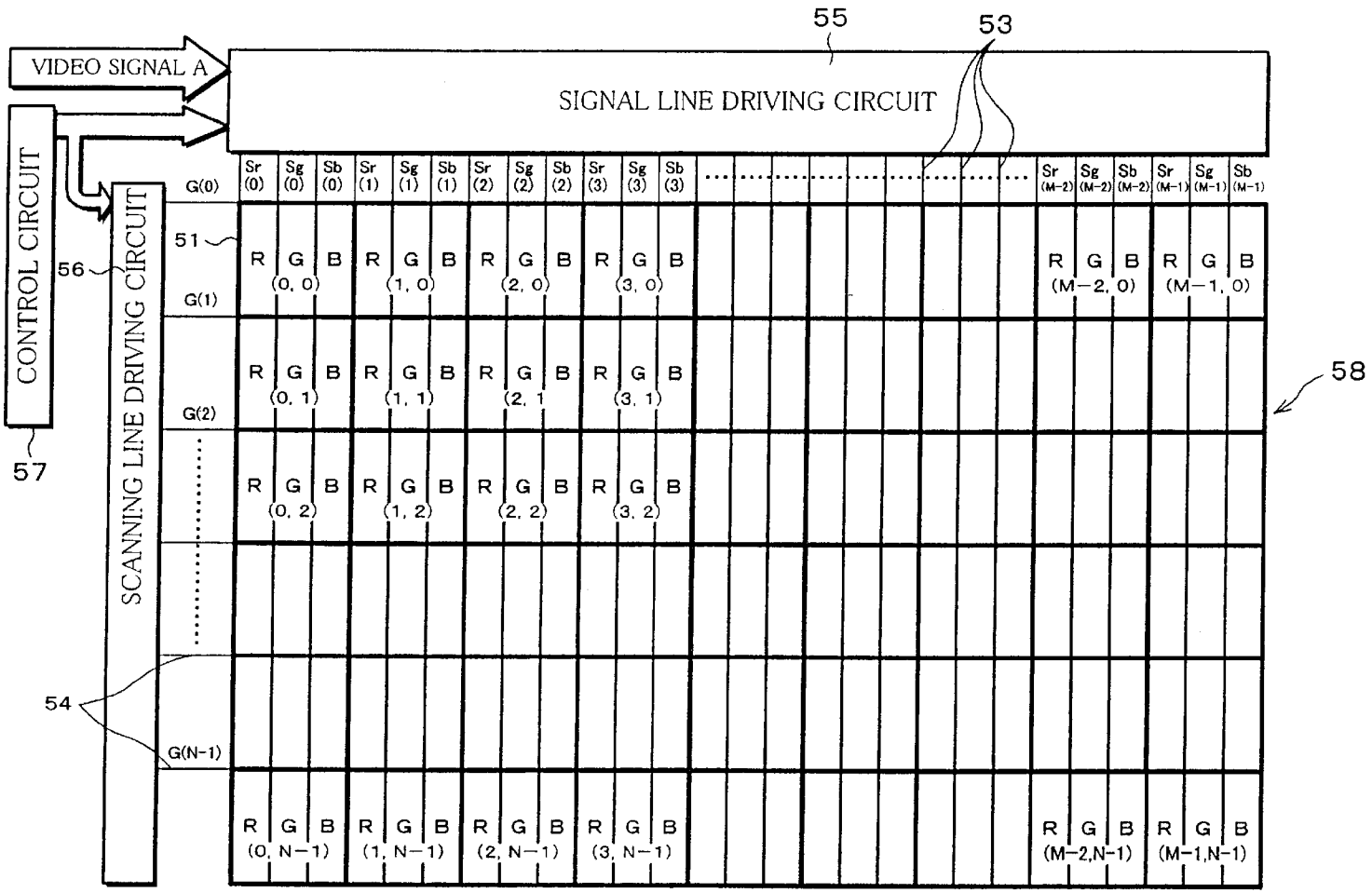
FIG. 10 Prior Art
FIG. 10 is a schematic view showing an overall configuration of a matrix display device having the arrangement of a pixel shown in FIG. 9.
Figure 11:
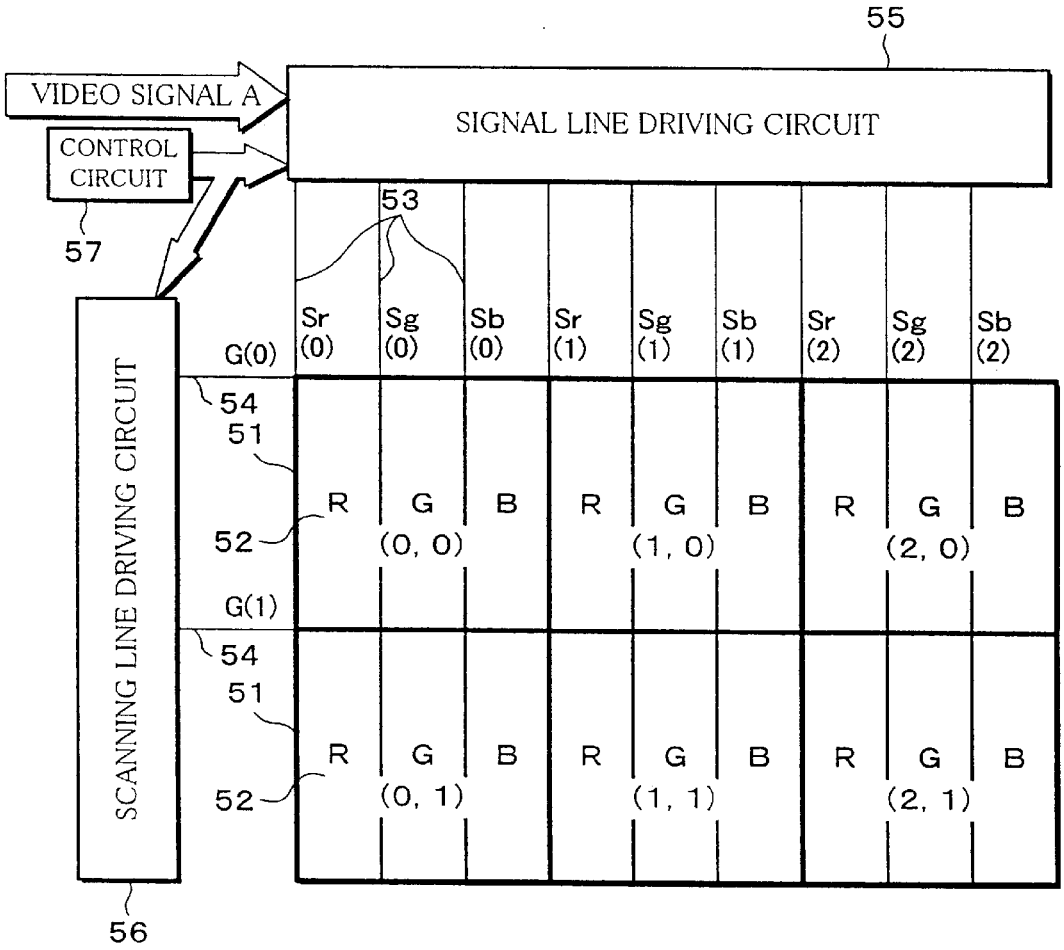
FIG. 11 Prior Art
FIG. 11 is a schematic view of a conventional matrix display device in which M (a horizontal direction)=3, and N (a vertical direction)=2.

Here for ease of explanation, FIG. 3 illustrates a low-resolution active matrix display device in which the number of cells 2 is calculated as follows: J (a horizontal direction)=3, and K (a vertical direction)=3 (signal lines: 3×2 (2 systems) lines; scanning lines: 3 lines). A basic configuration of this display device is the same as various signals in the signal line driving circuit 5 shown in FIG. 3. FIGS. 3 and 4 respectively correspond to FIGS. 10 and 11 showing prior art.

As shown in FIG. 4, the signal line driving circuit 5, at a timing ① of SEL_CK, makes sampling of video data of two cells 2 (two systems) arbitrarily selected from three cells 2 of a pixel 1, i.e., R(0,0), G(0,0) and B(0,0) which are shown, for example, in the upper left in FIG. 3. Here, there is made sampling of video data of two systems which are R(0,0) and G(0,0). These sampling data correspond to signals Se(0) and So(0) of two systems to be outputted to the signal lines 3. Likewise, at timings ② and ③, the samplings of video data of two systems which are R(1,0) and G(1,0), and R(2,0) and G(2,0), are respectively made. These sampling data correspond to signals Se(1) and So(1), and Se(2) and So(2) of two systems, which are outputted to the signal lines 3, respectively.

Thus, the signal line driving circuit 5 finishes sampling of one scanning portion of video data (video data of two systems) which corresponds to a scanning line g(0) (scanning line 4), thereafter outputting the signals Se and So of the two systems corresponding to these sampling data to each signal line 3. Likewise, the signal line driving circuit 5 makes sampling of one scanning portion of video data (video data of the two systems) which correspond to a next scanning line g(1) at timings ④, ⑤ and ⑥, so as to output the signals Se and So of the two systems corresponding to these sampling data to each signal line 3. Likewise, the signal line driving circuit 5 makes sampling of one scanning portion of video data (video data of the two systems) which correspond to a next scanning line g(2) at timings ⑦, ⑧ and ⑨, so as to output the signals Se and So of the two systems corresponding to these sampling data to each signal line 3.

Thus, in the present matrix display device, even with a sampling circuit of two systems can be performed display corresponding to the three colors R, G and B. In that case, since the video signal A is a digital signal, when, for example, using a video signal of RGB 8 bits, the present matrix display device requires sixteen sampling circuits according to the following calculation: 2 systems (Se, So)×8 bits, which is less than twenty-four sampling circuits required in a conventional arrangement, where the number of sampling circuits is calculated as follows: 3 systems (Sr, Sg, Sb)×8 bits.

Figure 5:
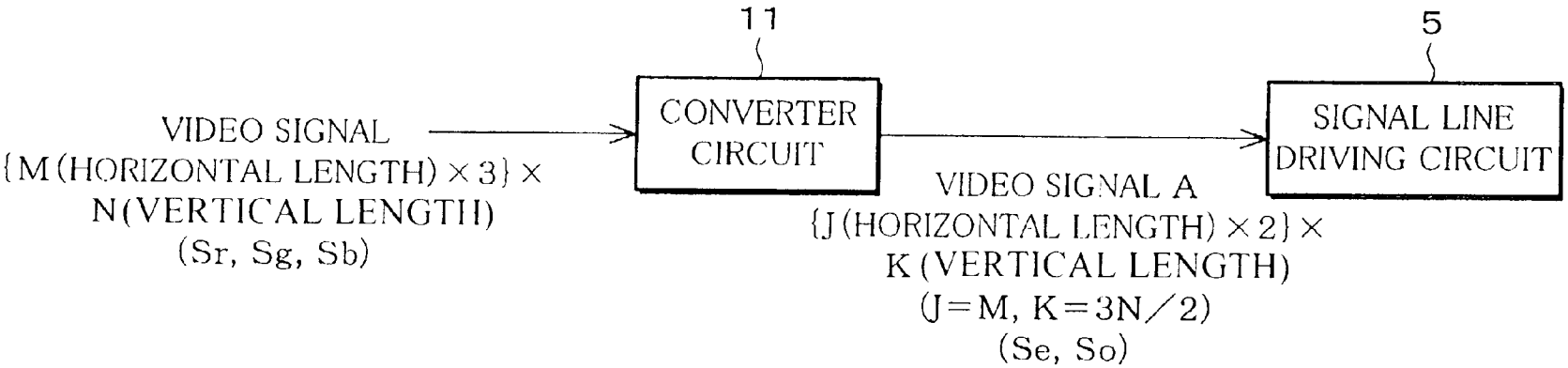
FIG. 5 is a block diagram showing a converter circuit included in the matrix display device of FIG. 3.

Further, the present matrix display device has a converter circuit 11 shown in FIG. 5. The converter circuit 11 converts a video signal corresponding to cells 2, the number of which is obtained as M (a horizontal direction)×3(R, G, B)×N (a vertical direction), into a video signal A corresponding to cells, the number of which is obtained as J (a horizontal direction)×2 (systems)×K (a vertical direction) (provided J=M, and K=3N/2). Note that, here, it is arranged that the converter circuit 11 be provided in a preceding stage of the signal line driving circuit 5; however, alternatively, the converter circuit 11 may be included in the signal line driving circuit 5.

Figure 8:
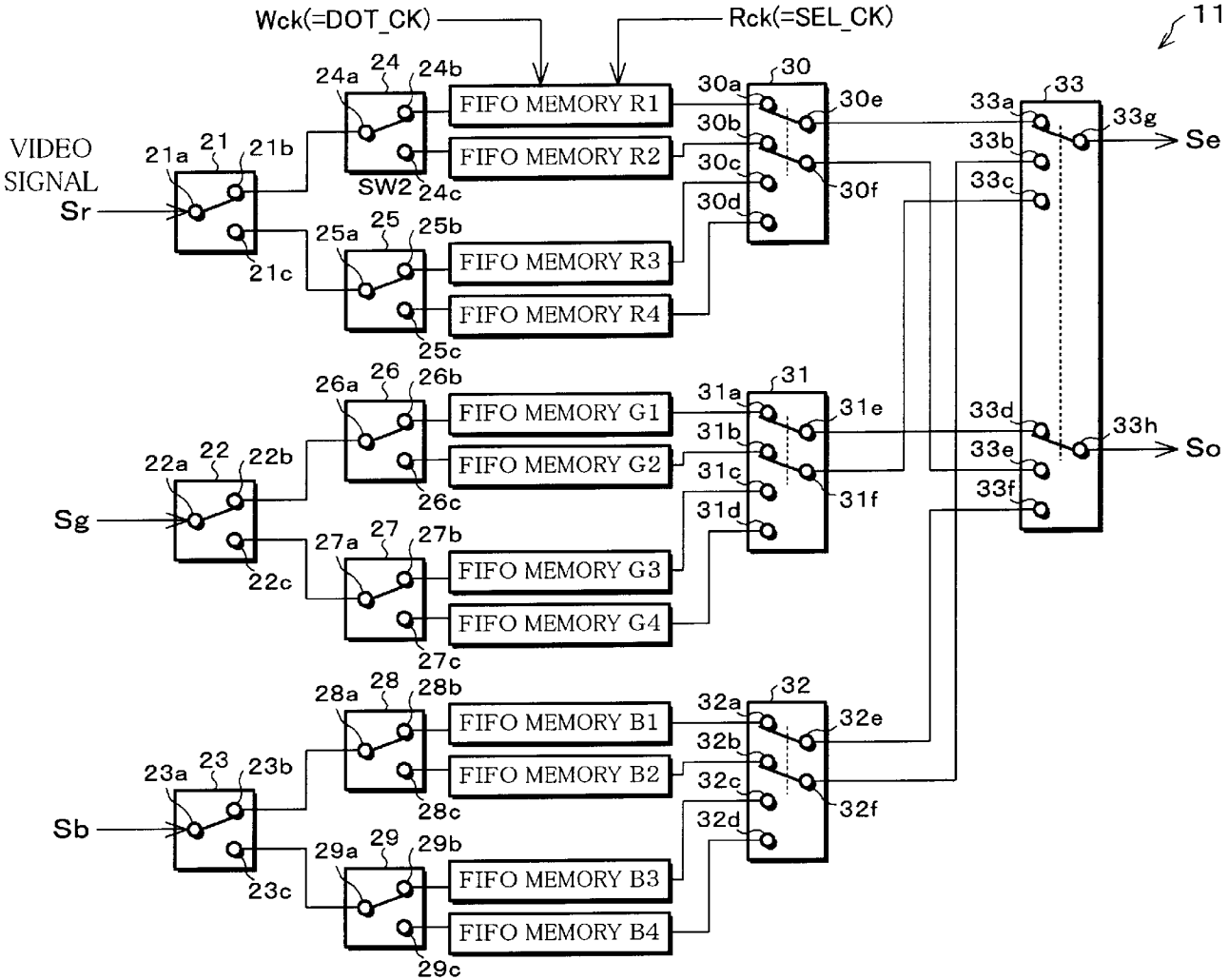
FIG. 8 is a circuit diagram specifically showing an arrangement of the converter circuit shown in FIG. 5.
Figure 9:
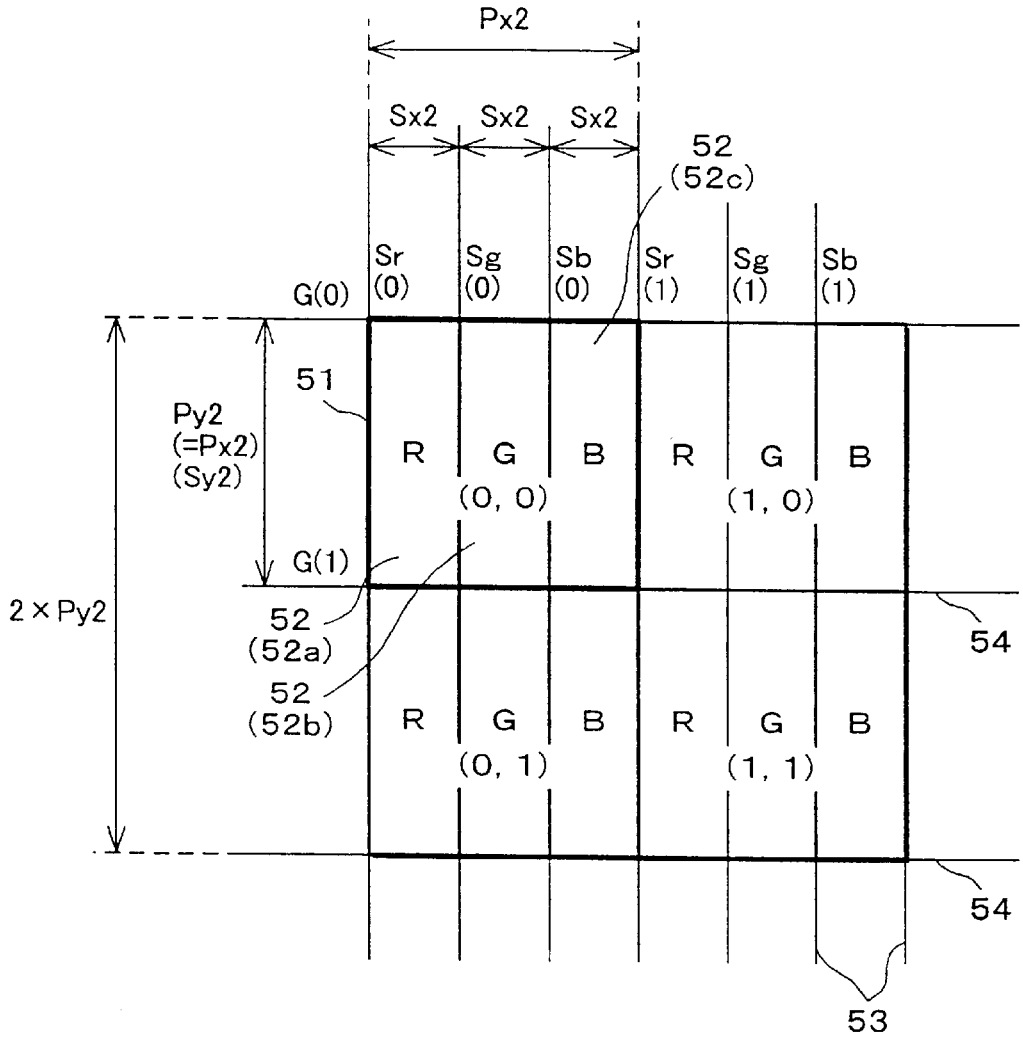
FIG. 9 Prior Art
FIG. 9 is an explanatory view showing an arrangement of a pixel made up of a plurality of cells and a disposing states of signal lines and scanning lines of a conventional matrix display device.

FIG. 8 shows a specific example of the converter circuit 11.

In FIG. 8, the converter circuit 11 includes three first stage switches 21 to 23, six second stage switches 24 to 29, twelve FIFO memories R1 to R4, G1 to G4 and B1 to B4, three third stage switches 30 to 32, and one fourth stage switch 33. Note that, variable terminals and fixed terminals in the following switches are only tentatively named for the sake of convenience, and such names are not intended to virtually refer to variable terminals and fix terminals.

To each of variable terminals 21*a*, 22*a* and 23*a* of the first stage switches 21, 22 and 23 is inputted one of video signals Sr, Sg and Sb of three systems. Fixed terminals 21*b*, 22*b* and 23*b* of the first stage switches 21, 22 and 23 are connected to variable terminals 24*a*, 26*a* and 28*a* of the second stage switches 21, 22 and 23. Fixed terminals 21*c*, 22*c* and 23*c* of the first stage switches 21, 22 and 23 are connected to variable terminals 25*a*, 27*a* and 29*a* of the second stage switches 25, 27 and 29.

Fixed terminals 24*b* and 24*c* of the second stage switch 24, and fixed terminals 25*b* and 25*c* of the second stage switch 25 are respectively connected to fixed terminals 30*a*, 30*b*, 30*c* and 30*d* of the third stage switch 30 via the FIFO memories R1, R2, R3 and R4 in-between. Fixed terminals 26*b* and 26*c* of the second stage switch 26, and fixed terminals 27*b* and 27*c* of the second stage switch 27 are respectively connected to fixed terminals 31*a*, 31*b*, 31*c* and 31*d* of the third stage switch 31 via the FIFO memories G1, G2, G3 and G4 in-between. Fixed terminals 28*b* and 28*c* of the second stage switch 28, and fixed terminals 29*b* and 29*c* of the second stage switch 29 are respectively connected to fixed terminals 32*a*, 32*b*, 32*c* and 32*d* of the third stage switch 32 via the FIFO memories B1, B2, B3 and B4 in-between.

Variable terminals 30*e* and 30*f* of the third stage switch 30, variable terminals 31*e* and 31*f* of the third stage switch 31, and variable terminals 3*e* and 32*f* of the third stage switch 32 are respectively connected to fixed terminals 33*a*, 33*e*, 33*d*, 33*c*, 33*f* and 33*b* of the fourth stage switch 33. In addition, the variable terminals 33*g* and 33*h* of the fourth stage switch 33 respectively output video signals A which are video signals Se and So of two systems.

Figure 12:
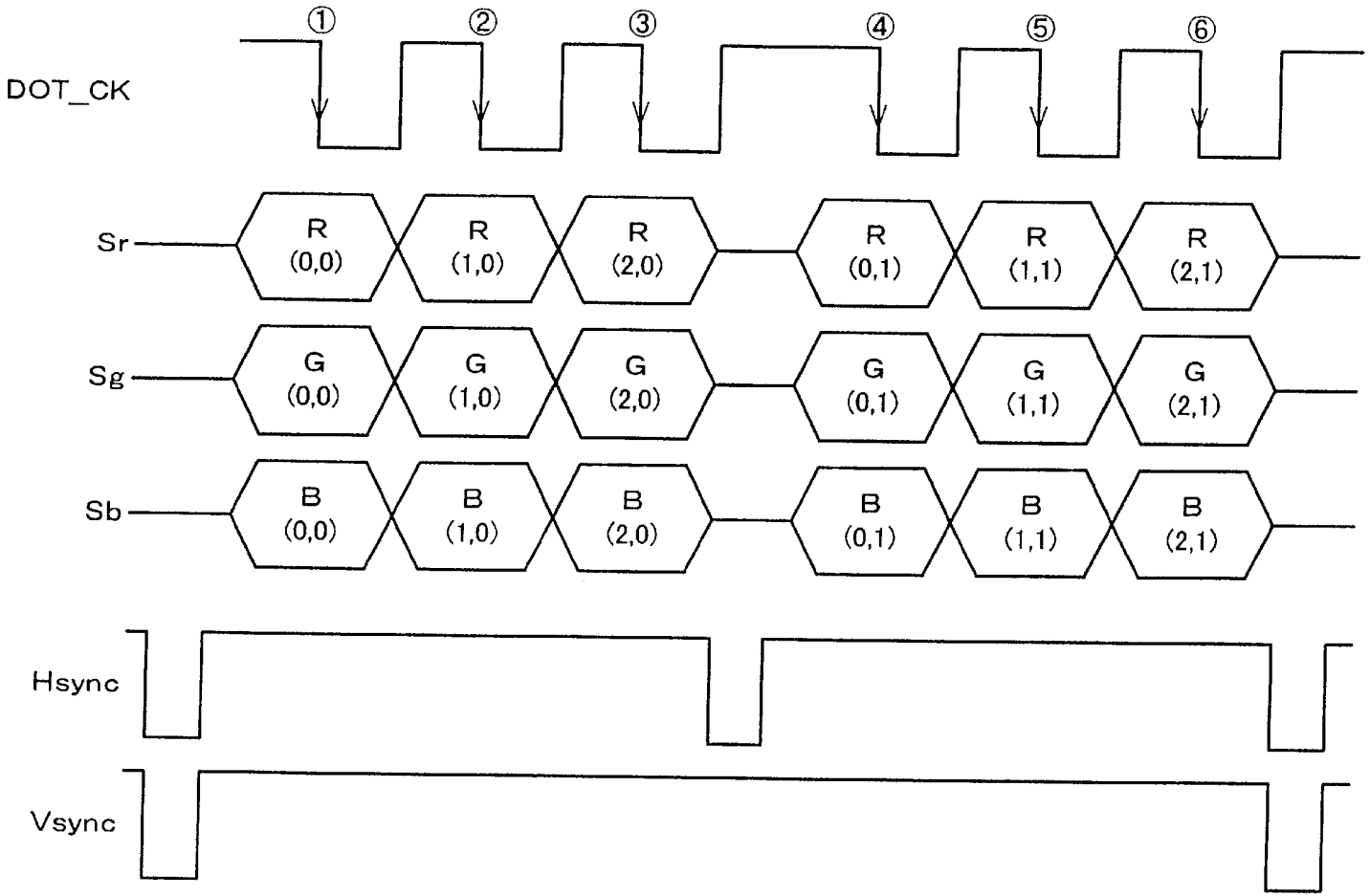
FIG. 12 Prior Art
FIG. 12 is a timing chart of various signals in a signal line driving circuit of the matrix display device shown in FIG. 11.

In the converter circuit 11, the first stage switches 21 to 23 are switched for every 2 Hsyncs shown in FIG. 12, and the second stage switches 24 to 29 are switched for every 1Hsync shown in FIG. 12. The switch of third stage switches 30 to 32 are interlocked with the switch of the first stage switches 21 to 23. The fourth stage switch 33 is switched for every 1 Hcont shown in FIG. 4. A Wck is a write clock, i.e., the clock to write data into each FIFO memory, and has a frequency of DOT_CK shown in FIG. 11. An Ack is a read clock, i.e., the clock to read out data from each FIFO memory, and has a frequency of SEL_CK shown in FIG. 4. Consequently, the frequency of the Rck is given as follows: (the frequency of the Rck)≈1.5×(the frequency of the Wck). With this arrangement, in the converter circuit 11, input of video signals Sr, Sg and Sb of three systems shown in FIG. 12 to the first stage switches 21 to 23 enables the video signals Se and So of two systems shown in FIG. 4 to be obtained from the variable terminals 33*g* and 33*h* of the fourth stage switch 33.

With the foregoing arrangement, in the present active matrix display device, for example, assuming that a high-definition panel having display density of 200 dpi is provided, the signal line 3 has a pitch of 60 μm which is 3/2 times the pitch of a signal line 3 of a conventional arrangement shown in FIG. 8. Hence, a connection pitch between the signal line 3 and the signal line driving circuit 5 is 60 μm which is 3/2 times the connection pitch of the conventional arrangement. Thus, a connection pitch between each output terminal of the signal line driving circuit 5 and each signal line 3 becomes wider than 50 μm that is the smallest size attainable for that purpose by the current technology, thereby enabling connection between the signal line driving circuit 5 and the signal line 3.

On the other hand, a wiring pitch of the scanning line 4, and a connection pitch between the scanning line 4 and the scanning line driving circuit 6 respectively are 80 μm which is 2/3 times the value of the conventional arrangement, i.e., these pitches are narrower than the conventional ones. However, the pitch of 80 μm is sufficiently larger than the limit value for connection of 50 μm, thereby raising no problems.

Further, the number of signal lines 3 becomes 2/3 times that of the conventional arrangement. By thus reducing the number of signal lines 3, the signal line driving circuit 5 can be produced at low cost.

As explained, in the present matrix display device, a small pitch of a signal line is widened so as to provide a wider connection pitch of the signal line, and the low-cost arrangement realizes high-definition display which is not attainable by the conventional technology. Furthermore, reduction in the number of sampling systems in the signal line driving circuit 5 simplifies sampling circuitry, thereby achieving a matrix display device at low cost.

Here, the following will explain the effect of cost reduction in the present active matrix display device, which is caused by a large reduction of the number of signal lines 3 when considering the entire driving circuitry including the signal line driving circuit 5 and the scanning line driving circuit 6.

In order to do so, for example, comparative results of a comparison between the present active matrix display device (system of the present invention) and a conventional arrangement (conventional system) when both of them are respectively adopted in a display device of UXGA (1,600×3 (RGB)×1,200) will be shown below.

Conventional System the number of signal lines: 1,600×3 (RGB)=4,800 the number of scanning lines: 1,200 the number of pixels: 1,920,000 the total number of the signal and scanning lines: 4,800+1,200=6,000

System of the Present Invention the number of signal lines: 1,600×3 (RGB)×2/3=3,200 the number of scanning lines: 1,200×3/2=1,800 the number of pixels: 1,920,000 the total number of the signal and scanning lines: 3,200+1,800=5,000

As described, when comparing the system of the present invention with the conventional system in terms of the total number of the signal and scanning lines, 5,000 lines are provided in the system of the present invention, while 6,000 lines in the conventional system. Moreover, since the cost of the signal line driving circuit 5 for each signal line 3 and the cost of the scanning line driving circuit 6 for each scanning line 4 are substantially the same, a ratio of the cost of driving circuitry in the system of the present invention to that in the conventional system is given as 5,000/6,000, that is, the cost of the driving circuity in the system of the present invention is 83% of that of the conventional system. Accordingly, the cost of the driving circuitry can be greatly reduced in the system of the present invention compared to the conventional system.

Note that, the system of the present invention and the conventional system have differences in the number of the signal lines and the number of the scanning lines, but have the same number of pixels. More specifically, both systems have the same number of pixels in one screen, hence the same pixel density (the number of pixels per unit area), thereby providing substantially the same display quality. Namely, the system of the present invention is superior to the conventional system in terms of a wiring pitch of a signal line 3, a connection pitch between the signal line 3 and the signal line driving circuit 5, and the cost of the driving circuitry, while securing the same display quality as the conventional system. Further, as discussed, the system of the present invention is capable of high-definition display.

Meanwhile, compared to the conventional system, the system of the present invention is capable of increasing a numerical aperture of the cell 2.

The numerical aperture of the cell 2 is a factor of great importance in the judgment of a display quality of a display device because in a transmissive liquid crystal display device using backlight for example, a low numerical aperture results in low display brightness, thereby extremely reducing display performance. Therefore, in order to increase brightness, the power of the backlight requires to be increased, thus failing to attain lower power consumption.

Here, for ease of explanation, without considering conditions such as a width of a light-shield mask pattern, it is assumed that the line widths of the signal line 3 and the scanning line 4 intact correspond to a light-shield portion. Assuming that the length of a cell in a horizontal direction is Sx, the length in a vertical direction is Sy, the line width of the signal line 3 is Ws, and the line width of the scanning line 4 is Wg, a numerical aperture is given as:

$$\text{a numerical aperture} = \text{the area of an aperture} / \text{the constituting area of a cell} = (Sx - Ws)(Sy - Wg)/(Sx \times Sy).$$

Figure 6:
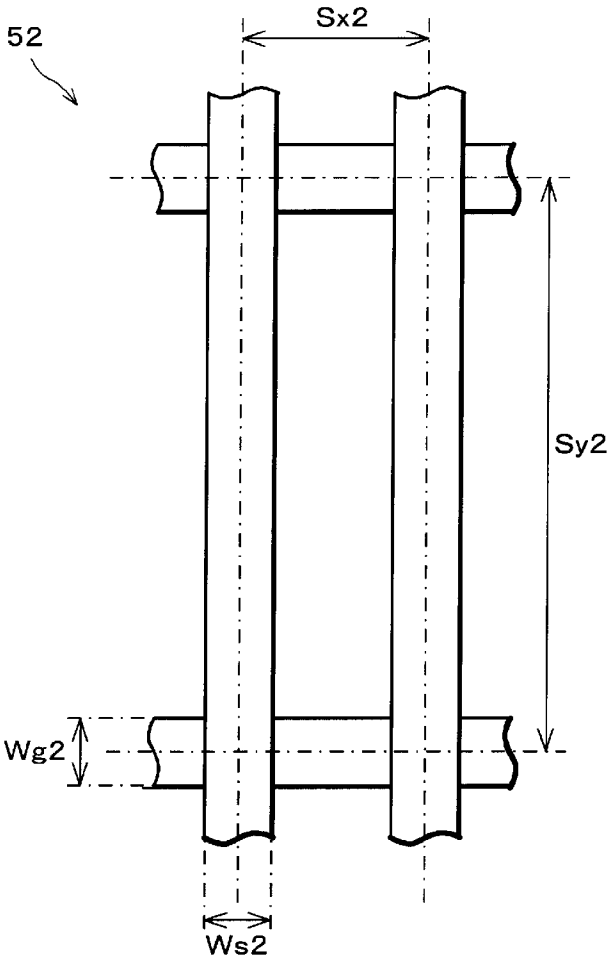
FIG. 6(*a*) is an explanatory view showing an opening portion of a cell of the matrix display device shown in FIG. 2.
Figure 6:
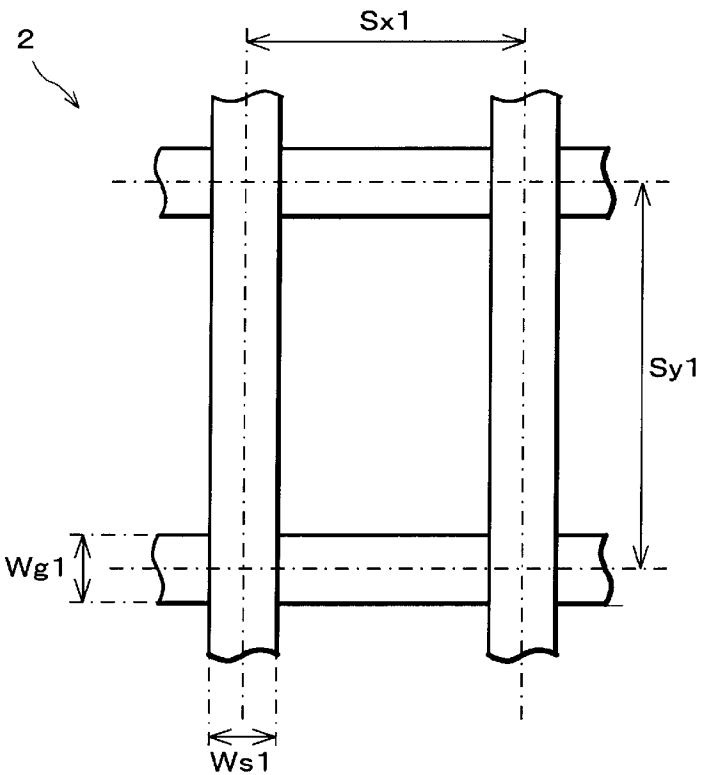

FIG. 6(*a*) shows the cell 2 of the system of the present invention. Accordingly, a numerical aperture of this cell 2 is given as:

$$\text{a numerical aperture} = (Sx\mathbf{1} - Ws\mathbf{1})(Sy\mathbf{1} - Wg\mathbf{1})/(Sx\mathbf{1} \times Sy\mathbf{1}).$$

On the other hand, FIG. 6(*b*) shows a cell 52 of the conventional system. Accordingly, a numerical aperture of the cell 52 is given as:

$$\text{a numerical aperture} = (Sx\mathbf{2} - Ws\mathbf{2})(Sy\mathbf{2} - Wg\mathbf{2})/(Sx\mathbf{2} \times Sy\mathbf{2}).$$

According to the present invention, a relationship between the cell size of the present invention and the conventional cell size holds:

$$Sx\mathbf{1} = (3/2) \times Sx\mathbf{2}, Sy\mathbf{1} = (2/3) \times Sy\mathbf{2}.$$

In addition, since Sy2=3×Sx2, $$Sx\mathbf{1} = (3/2) \times Sx\mathbf{2}, Sy\mathbf{1} = 2 \times Sx\mathbf{2}.$$

Further, when Sx2=S, $$Sx\mathbf{1} = (3/2)S,\ Sy\mathbf{1} = 2S, Sy\mathbf{2} = 3S.$$

Here, assuming that the signal line 3 and the scanning line 4 have the same line width, and Ws1=Ws2=Wg1=Wg2=W, a numerical aperture of the system of the present invention is given as:

$$\begin{aligned} \text{a numerical aperture} &= (Sx1 - Ws1)(Sy1 - Wg1)/(Sx1 \times Sy1) \quad (1) \\ &= ((3/2)S - W)(2S - W)/((3/2)S \times 2S) \\ &= (3S^2 - 3.5SW + W^2)/3S^2 \\ &= 1 + W^2/3S^2 - 3.5SW/3S^2. \end{aligned}$$

Further, a numerical aperture of the conventional system is given as:

$$\begin{aligned} \text{a numerical aperture} &= (Sx2 - Ws2)(Sy2 - Wg2)/(Sx2 \times Sy2) \quad (2) \\ &= (S - W)(3S - W)/(S \times 3S) \\ &= (3S^2 - 4SW + W^2)/3S^2 \\ &= 1 + W^2/3S^2 - 4SW/3S^2. \end{aligned}$$

More specifically, in the system of the present invention, assuming that the pitch of a signal line 3=15 μm, the pitch of a scanning line 4=20 μm, and each line width=4 μm (the cell area (300 μm)$^2$), a numerical aperture of the system of the present invention is given as:

a numerical aperture=59%.

On the other hand, in the conventional system, since the pitch of a signal line 53=10 μm, the pitch of a scanning line 54=30 μm, and each line width=4 μm (the cell area (300 μm)$^2$), a numerical aperture in the conventional system is given as:

a numerical aperture=52%.

As a result, in the system of the present invention, it is possible to increase a numerical aperture by not less than 10% of the conventional system. Note that, in the foregoing example, n=0.4. This n will be explained below.

Figure 7:
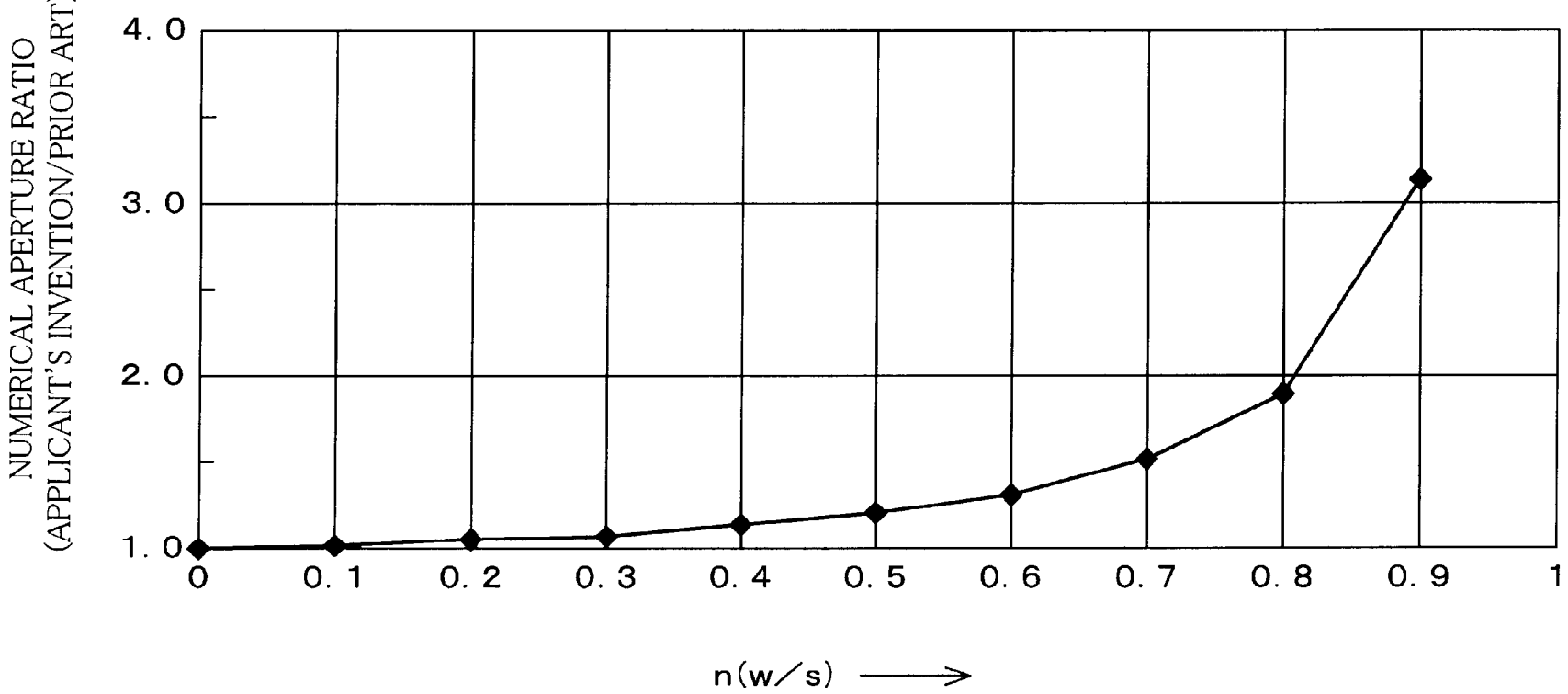
FIG. 7 is a graph showing a ratio of a numerical aperture of the cell of the conventional matrix display device to a numerical aperture of the cell of the matrix display device according to the present invention, based on respective ratios of a width of a signal line (scanning line) to the size of a cell.

Commonly, when W=nS (provided $0 \leqq n < 1$), according to equations (1) and (2) above, a ratio R of numerical apertures in the system of the present invention and the conventional system is given as:

$$R = \frac{(3S/2 - W)(2S - W)}{(S - W)(3S - W)} = \frac{(3 - 2n)\ (2 - n)}{2(1 - n)\ (3 - n)}$$

and the results of calculation are shown in Table 1 and FIG. 7.

The results show that, as n becomes larger, i.e., when using a high-definition display device having a signal line 3 of a smaller pitch, the use of the system of the present invention results in a greater increase in a numerical aperture. More specifically, because of a limit in reducing a pitch of the signal line 3, particularly the n becomes large in the high-definition display device. In that case, the system of the present invention is effective.

TABLE 1

| n (= W/S) | NUMERICAL APERTURE RATIO (PRESENT INVENTION/PRIOR ART) |
|---|---|
| 0 | 1.00 |
| 0.1 | 1.02 |
| 0.2 | 1.04 |
| 0.3 | 1.08 |
| 0.4 | 1.13 |
| 0.5 | 1.20 |
| 0.6 | 1.31 |
| 0.7 | 1.51 |
| 0.8 | 1.91 |
| 0.9 | 3.14 |

Note that, in the foregoing Embodiment, explanation has been made through the case where the first to third colors are a combination of red, blue and green in an arbitrary sequence; however, the combination of colors is not limited to this. For example, a combination of cyan, magenta and yellow in an arbitrary sequence may be adopted instead.

As discussed, a matrix display device according to the present invention which has a plurality of signal lines and a plurality of scanning lines crossing one another, and a plurality of pixels each one of which includes three cells of first, second and third colors such as red, green and blue, wherein:

when the three cells composing one pixel are first, second and third cells in an arbitrary sequence, the second cell is disposed on one side of the first cell in a signal line alignment direction while disposing the third cell on the other side of the first cell in a scanning line alignment direction, and the first to third cells form the shape of a letter L, one pixel and another pixel adjacent to either one side of the one pixel in the scanning line alignment direction are a first pixel in the shape of the letter L and a second pixel in the shape of the letter L and in a state rotating by 180° with respect to the first pixel, respectively, the first and second pixels being paired with each other and disposed so that the combination of the two pixels form a square, and a ratio of the length of a side of the square in the signal line alignment direction to the length of a side of the square in the scanning line alignment direction is 1:2.

With this arrangement, the number of cells in the signal line alignment direction and the number of signal lines can be reduced. This realizes a wider connection pitch between the signal line driving circuit and the signal line while allowing a wiring pitch of the signal line and the connection pitch between the signal line driving circuit and the signal line to be smaller, thereby producing a high-definition matrix display device.

Note that, thus having the smaller wiring pitch of the scanning line and connection pitch between the scanning line and the scanning line driving circuit raises no problems because these pitches are originally set to be larger than pitches on the side of the signal lines.

A matrix display device according to the present invention which has a plurality of signal lines and a plurality of scanning lines crossing one another, and a plurality of pixels each one of which includes three cells of first, second and third colors such as red, green and blue, wherein:

when the cells of first to third colors composing one pixel are first to third cells in an arbitrary sequence, the second cell is disposed on one side of the first cell in a signal line alignment direction while disposing the third cell on the other side of the first cell in a scanning line alignment direction, and the first to third cells form the shape of a letter L, one pixel and another pixel adjacent to either one side of the one pixel in the scanning line alignment direction are a first pixel in the shape of the letter L and a second pixel in the shape of the letter L and in a state rotating by 180° with respect to the first pixel, respectively, the first and second pixels being paired with each other and disposed so that the combination of the two pixels form a square, and all the pixels adjacently disposed in the signal line alignment direction have the same combination of colors of the first and second cells.

With this arrangement, the number of cells in the signal line alignment direction and the number of signal lines can be reduced. This realizes a wider connection pitch between the signal line driving circuit and the signal line while allowing a wiring pitch of the signal line and the connection pitch between the signal line driving circuit and the signal line to be smaller, thereby producing a high-definition matrix display device.

Note that, thus having the smaller wiring pitch of the scanning line and connection pitch between the scanning line and the scanning line driving circuit raises no problems because these pitches are originally set to be larger than pitches on the side of the signal lines.

A matrix display device according to the present invention which has a plurality of signal lines and a plurality of scanning lines crossing one another, and a plurality of pixels each one of which includes three cells, wherein:

a ratio of the number of pixels disposed in a signal line alignment direction to the number of the signal lines is 1:2, and a ratio of the number of pixels disposed in a scanning line alignment direction to the number of the scanning lines is 2:3, and a ratio of the length of a side of each cell in the signal line alignment direction to the length of a side of the cell in the scanning line alignment direction is 1.5:2.

With this arrangement, since the ratio of the number of pixels disposed in the signal line alignment direction to the number of the signal lines is 1:2, a wiring pitch of the signal line can be made larger than a conventional arrangement having a ratio of 1:3. This realizes a wider connection pitch between the signal line driving circuit and the signal line while allowing a wiring pitch of the signal line and the connection pitch between the signal line driving circuit and the signal line to be smaller, thereby producing a high-definition matrix display device.

Note that, since the ratio of the number of pixels disposed in the scanning line alignment direction to the number of the scanning lines is 2:3, thus having the wiring pitch of the scanning line and connection pitch between the scanning line and the scanning line driving circuit that is smaller than a conventional arrangement having a ratio of 1:1 raises no problems because these pitches are originally set to be larger than pitches on the side of the signal lines.

Further, since the ratio of the length of a side of each cell in the signal line alignment direction to the length of a side of the cell in the scanning line alignment direction is 1.5:2, a numerical aperture can be greatly increased compared to a conventional arrangement having a ratio of 1:3, thereby attaining high-quality display.

The matrix display device may have an arrangement in which a ratio of the length of a side of each cell in the signal line alignment direction to the length of a side of the cell in the scanning line alignment direction is 1.5:2.

With this arrangement, since the ratio of the length of a side of each cell in the signal line alignment direction to the length of a side of the cell in the scanning line alignment direction is 1.5:2, a numerical aperture can be greatly increased compared to a conventional arrangement having a ratio of 1:3, thereby attaining high-quality display.

The matrix display device may have an arrangement in which cells of a display section which are adjacently disposed in the signal line alignment direction and cells of the display section which are adjacently disposed in the scanning line alignment direction respectively have a color different from each other.

This arrangement prevents occurrence of visually noticeable deviation in color which may be caused in the case where cells adjacently disposed in the signal line alignment direction and/or scanning lines have the same color, thereby attaining high-quality display.

More specifically, when the cells adjacently disposed in the signal line alignment direction and/or scanning lines have the same color, for example, when cells of G (green) are adjacently disposed, the color (i.e., G) is partially emphasized. As a result, though in reality no deviation in color occurs, yet it gives impression that visually noticeable deviation in color occurs. This can be prevented in the foregoing arrangement.

The matrix display device may have an arrangement in which a ratio of a wiring pitch of the signal line to a wiring pitch of the scanning line is 1.5:2.

With this arrangement, the wiring pitch of the signal line becomes larger than that of a conventional arrangement having a ratio of the wiring pitch of the signal line to the wiring pitch of the scanning line of 1:3. This realizes a wider connection pitch between the signal line driving circuit and the signal line while allowing a wiring pitch of the signal line and the connection pitch between the signal line driving circuit and the signal line to be smaller, thereby producing a high-definition matrix display device.

Note that, thus having the smaller wiring pitch of the scanning line and connection pitch between the scanning line and the scanning line driving circuit raises no problems because these pitches are originally set to be larger than pitches on the side of the signal lines.

The matrix display device may have an arrangement in which one pixel is made up of three cells of first, second and third colors, a signal line driving circuit for supplying video data to a signal line connected to the pixel is provided, and when making sampling of video data from an inputted video signal, the signal line driving circuit simultaneously makes sampling of two of the video data of the first, second and third colors.

With this arrangement, a high-definition panel is realized while reducing the respective number of video data lines, video data output circuits and video data sampling circuits (⅔ the number of a conventional arrangement). For example, in the case of bits of the first to third colors (3×8 bits), twenty-four video data lines and other circuits according thereto were conventionally required; however, in the present invention, only sixteen video data lines and other circuits according thereto are required.

The matrix display device may have an arrangement in which a video signal to be inputted corresponds to cells of the display device, the number of which is given as M×3 (the first, second, third colors)×N cells; and a converter circuit for converting the video signal into a video signal having a structure of J×2 (systems)×K (provided J=M, and K=3N/2) is provided.

The matrix display device may have an arrangement in which a cell of the first pixel and a cell of the second pixel are scanned on a single scanning line.

This enables scan of each cell even when a pixel has the shape of a letter L.

Further, as discussed, a matrix display device according to the present invention which has a plurality of signal lines and a plurality of scanning lines crossing one another, and a plurality of pixels each one of which includes three cells of red, blue and green, wherein:

a video signal arranged to be displayed by a display element which has M×3 cells disposed in a signal line alignment direction and N cells disposed in a scanning line alignment direction is inputted so as to display an image according to the video signal by a display device having J×2 cells disposed in the signal line alignment direction and K cells (provided J=M, K=3N/2) in the scanning line alignment direction.

With this arrangement, to the matrix display device is inputted a video signal arranged to be displayed by a display element having M×3 cells (three cells of RGB) in the signal line alignment direction and N cells in the scanning line alignment direction, so as to display an image according to the video signal by a display element having J×2 cells in the signal line alignment direction and K cells in the scanning line alignment direction. Accordingly, the number of cells in the signal line alignment direction and the number of the signal lines can be reduced. This realizes a wider connection pitch between the signal line driving circuit and the signal line while allowing a wiring pitch of the signal line and the connection pitch between the signal line driving circuit and the signal line to be smaller, thereby producing a high-definition matrix display device.

Note that, thus having the smaller wiring pitch of the scanning line and connection pitch between the scanning line and the scanning line driving circuit raises no problems because these pitches are originally set to be larger than pitches on the side of the signal lines.

Further, a matrix display device according to the present invention which has a plurality of signal lines and a plurality of scanning lines crossing one another, and a plurality of pixels each one of which includes three cells of red, blue and green, wherein:

a ratio of the length of a side of each cell in a signal line alignment direction to the length of a side of the cell in a scanning line alignment direction is 1.5:2.

With this arrangement, in the matrix display device, a ratio of the length of a side of each cell composing one pixel in the signal line alignment direction to the length of a side of the cell in the scanning line alignment direction is 1.5:2. Therefore, a wiring pitch of the signal line can be made larger than that of a conventional arrangement in which a ratio of the length of a side of each cell composing one pixel in the signal line alignment direction to the length of a side of the cell in the scanning line alignment direction is 1:3. This realizes a wider connection pitch between the signal line driving circuit and the signal line while allowing a wiring pitch of the signal line and the connection pitch between the signal line driving circuit and the signal line to be smaller, thereby producing a high-definition matrix display device.

Note that, thus having the smaller wiring pitch of the scanning line and connection pitch between the scanning line and the scanning line driving circuit raises no problems because these pitches are originally set to be larger than pitches on the side of the signal lines.

In addition, a numerical aperture can be greatly increased compared to the conventional arrangement in which the ratio of the length of a side of each cell composing one pixel in the signal line alignment direction to the length of a side of the cell in the scanning line alignment direction is 1:3, thereby attaining high-quality display.

Further, a matrix display device according to the present invention which has a plurality of signal lines and a plurality of scanning lines crossing one another, and a plurality of pixels each one of which includes three cells of red, blue and green, wherein:

a video signal arranged to be displayed by a display element which has M×3 cells disposed in a signal line alignment direction and N cells disposed in a scanning line alignment direction is inputted so as to display an image according to the video signal by a display device having J×2 cells disposed in the signal line alignment direction and K cells (provided J=M, K=3N/2) in the scanning line alignment direction, and a ratio of the length of a side of each cell in the signal line alignment direction to the length of a side of the cell in the scanning line alignment direction is 1.5:2.

With this arrangement, to the matrix display device is inputted a video signal arranged to be displayed by a display element having M×3 cells (three cells of RGB) in the signal line alignment direction and N cells in the scanning line alignment direction, so as to display an image according to the video signal by a display element having J×2 cells in the signal line alignment direction and K cells in the scanning line alignment direction. Accordingly, the number of cells in the signal line alignment direction and the number of the signal lines can be reduced. This realizes a wider connection pitch between the signal line driving circuit and the signal line while allowing a wiring pitch of the signal line and the connection pitch between the signal line driving circuit and the signal line to be smaller, thereby producing a high-definition matrix display device.

Further, in the matrix display device, a ratio of the length of a side of each cell composing one pixel in the signal line alignment direction to the length of a side of the cell in the scanning line alignment direction is 1.5:2. Therefore, a wiring pitch of the signal line can be made larger than that of a conventional arrangement in which a ratio of the length of a side of each cell composing one pixel in the signal line alignment direction to the length of a side of the cell in the scanning line alignment direction is 1:3. This realizes a wider connection pitch between the signal line driving circuit and the signal line while allowing a wiring pitch of the signal line and the connection pitch between the signal line driving circuit and the signal line to be smaller, thereby producing a high-definition matrix display device.

Furthermore, when vertical and horizontal pitches of display are the same, for example, when displaying a circle or a square, these are not displayed as an ellipse and a rectangle, thus accurately displaying the circle and the square.

Further, a matrix display device according to the present invention, which has a plurality of signal lines and a plurality of scanning lines crossing one another, and a plurality of pixels each one of which includes three cells of red, blue and green, may have an arrangement in which a ratio of a wiring pitch of the signal line to a wiring pitch of the scanning line is 1.5:2.

With this arrangement, in the matrix display device, the ratio of a wiring pitch of the signal line to a wiring pitch of the scanning line is 1.5:2. Accordingly, a wiring pitch of the signal line can be made larger than a conventional arrangement in which a ratio of a wiring pitch of the signal line to a wiring pitch of the scanning line is 1:3. This realizes a wider connection pitch between the signal line driving circuit and the signal line while allowing a wiring pitch of the signal line and the connection pitch between the signal line driving circuit and the signal line to be smaller, thereby producing a high-definition matrix display device.

Note that, thus having the smaller wiring pitch of the scanning line and connection pitch between the scanning line and the scanning line driving circuit raises no problems because these pitches are originally set to be larger than pitches on the side of the signal lines.

In the matrix display device, when the cells of red, blue and green composing one pixel are first to third cells in an arbitrary sequence, the second cell is disposed on one side of the first cell in a signal line alignment direction while disposing the third cell on the other side of the first cell in a scanning line alignment direction, and the first to third cells form the shape of a letter L.

With this arrangement, the foregoing matrix display devices can readily be attained with high definition.

Further, the matrix display device may have an arrangement in which one pixel and another pixel disposed adjacent to either one side of the former pixel in the scanning line alignment direction are paired with each other and disposed so that a combination of the two pixels both in the shape of a letter L form a square, and a cell of one of the pixels in combination and a cell of the other of the pixels in combination are scanned on a single scanning line, thereby enabling scan of each cell even when a pixel has the shape of the letter L.

The matrix display device may have an arrangement in which one pixel is made up of three cells of red, blue and green, a signal line driving circuit for supplying video data to a signal line connected to the pixel is provided, and when making sampling of video data from an inputted video signal, the signal line driving circuit simultaneously makes sampling of two of the video data of red, blue and green.

With this arrangement, a high-definition panel is realized while reducing the respective number of video data lines, video data output circuits and video data sampling circuits (⅔ the number of a conventional arrangement). For example, in the case of bits of R, G and B (3×8 bits), twenty-four video data lines and other circuits according thereto were conventionally required; however, in the present invention, only sixteen video data lines and other circuits according thereto are required.

The matrix display device may have an arrangement in which a video signal to be inputted corresponds to cells of the display device, the number of which is given as M×3 (R, G, B)×N cells; and a converter circuit for converting the video signal into a video signal having a structure of J×2 (systems)×K (provided J=M, and K=3N/2) is provided.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

What is claimed is:

1. A matrix display device which has a plurality of signal lines and a plurality of scanning lines crossing one another, and a plurality of pixels each one of which includes three cells of first, second and third colors, wherein:

when the cells of first to third colors composing one pixel are first to third cells in an arbitrary sequence, the second cell is disposed on one side of the first cell in a signal line alignment direction while disposing the third cell on the other side of the first cell in a scanning line alignment direction, and the first to third cells form the shape of a letter L, wherein a ratio of the length of a side of each cell in the signal line alignment direction to the length of a side of the cell in the scanning line alignment direction is 1.5:2;

one pixel and another pixel adjacent to either one side of the former pixel in the scanning line alignment direction are a first pixel in the shape of the letter L and a second pixel in the shape of the letter L and in a state rotating by 180° with respect to the first pixel, respectively, the first and second pixels being paired with each other and disposed so that the combination of the two pixels form a rectangle; and all of the first pixels have the same combination of colors of the first to third cells, and all of the second pixels have the same combination of colors of the first to third cells.

2. The matrix display device as set forth in claim 1, wherein cells of a display section which are adjacently disposed in the signal line alignment direction, and cells of the display section which are adjacently disposed in the scanning line alignment direction respectively have a difference in color.

3. The matrix display device as set forth in claim 1, wherein a ratio of a wiring pitch of the signal line to a wiring pitch of the scanning line is 1.5:2.

4. The matrix display device as set forth in claim 1, wherein one pixel is made up of three cells of first, second and third colors, and a signal line driving circuit for supplying video data to a signal line connected to the pixel is provided, and when making sampling of video data from an inputted video signal, the signal line driving circuit simultaneously makes sampling of two of the video data of the first, second and third colors.

5. The matrix display device as set forth in claim 1, wherein a video signal to be inputted corresponds to cells of the display device, the number of which is given as M×3 (the first, second, third colors)×N cells, and a converter circuit for converting the video signal into a video signal having a structure of J×2 (systems)×K (provided J=M, and K=3N/2) is provided.

6. The matrix display device as set forth in claim 1, wherein a cell of the first pixel and a cell of the second pixel are scanned on a single scanning line.

7. The matrix display device as set forth in claim 1, wherein the first, second and third colors are three colors red, blue and green in an arbitrary sequence.

8. A matrix display device which has a plurality of signal lines and a plurality of scanning lines crossing one another, and a plurality of pixels each one of which includes three cells of first, second and third colors, wherein:

when the three cells composing one pixel are first to third cells in an arbitrary sequence, the second cell is disposed on one side of the first cell in a signal line alignment direction while disposing the third cell on the other side of the first cell in a scanning line alignment direction, and the first to third cells form the shape of a letter L, wherein a ratio of the length of a side of each cell in the signal line alignment direction to the length of a side of the cell in the scanning line alignment direction is 1.5:2;

one pixel and another pixel adjacent to either one side of the one pixel in the scanning line alignment direction are a first pixel in the shape of the letter L and a second pixel in the shape of the letter L and in a state rotating by 180° with respect to the first pixel, respectively, the first and second pixels being paired with each other and disposed so that the combination of the two pixels form a rectangle; and a ratio of the length of a side of the rectangle in the signal line alignment direction to the length of a side of the rectangle in the scanning line alignment direction is 1:2.

9. The matrix display device as set forth in claim 8, wherein cells of a display section which are adjacently disposed in the signal line alignment direction, and cells of the display section which are adjacently disposed in the scanning line alignment direction respectively have a different in color.

10. The matrix display device as set forth in claim 8, wherein a ratio of a wiring pitch of the signal line to a wiring pitch of the scanning line is 1.5:2.

11. The matrix display device as set forth in claim 8, wherein: one pixel is made up of three cells of first, second and third colors, and a signal line driving circuit for supplying video data to a signal line connected to the pixel is provided, and when making sampling of video data from an inputted video signal, the signal line driving circuit simultaneously makes sampling of two of the video data of the first, second and third colors.

12. The matrix display device as set forth in claim 8, wherein a video signal to be inputted corresponds to cells of the display device, the number of which is given as M×3 (the first, second, third colors)×N cells, and a converter circuit for converting the video signal into a video signal having a structure of J×2 (systems)×K (provided J=M, and K=3N/2) is provided.

13. The matrix display device as set forth in claim 8, wherein a cell of the first pixel and a cell of the second pixel are scanned on a single scanning line.

14. The matrix display device as set forth in claim 8, wherein the first, second and third colors are three colors red, blue and green in an arbitrary sequence.

15. A matrix display device which has a plurality of signal lines and a plurality of scanning lines crossing one another, and a plurality of pixels each one of which includes three cells of first, second and third colors, wherein:

when the cells of first to third colors composing one pixel are first to third cells in an arbitrary sequence, the second cell is disposed on one side of the first cell in a signal line alignment direction while disposing the third cell on the other side of the first cell in a scanning line alignment direction, and the first to third cells form the shape of a letter L, wherein a ratio of the length of a side of each cell in the signal line alignment direction to the length of a side of the cell in the scanning line alignment direction is 1.5:2; one pixel and another pixel adjacent to either one side of the former pixel in the scanning line alignment direction are a first pixel in the shape of the letter L and a second pixel in the shape of the letter L and in a state rotating by 180° with respect to the first pixel, respectively, the first and second pixels being paired with each other and disposed so that the combination of the two pixels form a rectangle; and all of the pixels adjacently disposed in the signal line alignment direction have the same combination of colors of the first and second cells.

16. The matrix display device as set forth in claim 15, wherein cells of a display section which are adjacently disposed in the signal line alignment direction, and cells of the display section which are adjacently disposed in the scanning line alignment direction respectively have a difference in color.

17. The matrix display device as set forth in claim 15, wherein a ratio of a wiring pitch of the signal line to a wiring pitch of the scanning line is 1.5:2.

18. The matrix display device as set forth in claim 15, wherein one pixel is made up of three cells of first, second and third colors, and a signal line driving circuit for supplying video data to a signal line connected to the pixel is provided, and when making sampling of video data from an inputted video signal, the signal line driving circuit simultaneously makes sampling of two of the video data of the first, second and third colors.

19. The matrix display device as set forth in claim 15, wherein a video signal to be inputted corresponds to cells of the display device, the number of which is given as M×3 (the first, second, third colors)×N cells, and a converter circuit for converting the video signal into a video signal having a structure of J×2 (systems)×K (provided J=M, and K=3N/2) is provided.

20. The matrix display device as set forth in claim 15, wherein the first, second and third colors are three colors red, blue and green in an arbitrary sequence.

* * * * *